US008538297B2

(12) United States Patent
Jeon et al.

(10) Patent No.: US 8,538,297 B2
(45) Date of Patent: Sep. 17, 2013

(54) CHARGING APPARATUS USING CHARGING TUBE AND IMAGE FORMING APPARATUS HAVING THE SAME

(75) Inventors: In-cheol Jeon, Yongin-si (KR); Ki-jae Do, Suwon-si (KR); Jong-hwa Joo, Suwon-si (KR); Yong-hoon Lee, Yongin-si (KR); Sang-jin Park, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 161 days.

(21) Appl. No.: 13/067,897

(22) Filed: Jul. 5, 2011

(65) Prior Publication Data

US 2012/0045251 A1 Feb. 23, 2012

(30) Foreign Application Priority Data

Aug. 19, 2010 (KR) ..... 10-2010-0080358

(51) Int. Cl.
*G03G 15/02* (2006.01)

(52) U.S. Cl.
USPC ..... 399/174; 399/176

(58) Field of Classification Search
USPC ..... 399/174, 176
See application file for complete search history.

(56) References Cited

U.S. PATENT DOCUMENTS 6,493,526 B2 * 12/2002 Sato ..... 399/109
2002/0054772 A1 * 5/2002 Sato ..... 399/109

FOREIGN PATENT DOCUMENTS

JP 07098535 A * 4/1995
JP 11153898 A * 6/1999
JP 2002099133 A * 4/2002

* cited by examiner

*Primary Examiner* — G. M. Hyder
(74) *Attorney, Agent, or Firm* — Staas & Halsey LLP

(57) ABSTRACT

A charging apparatus including a charging tube which has an outer surface contacting a photoconductive medium and electrically charges a surface of the photoconductive medium, a shaft which is disposed in the charging tube and to which a charging voltage is applied, and a conductive member which is connected to the shaft and contacts an inner surface of the charging tube. A friction coefficient between the conductive member and the inner surface of the charging tube may be less than a friction coefficient between the photoconductive medium and the outer surface of the charging tube, so that a slip phenomenon of the charging tube is prevented.

18 Claims, 10 Drawing Sheets

CHARGING APPARATUS USING CHARGING TUBE AND IMAGE FORMING APPARATUS HAVING THE SAME

CROSS-REFERENCE TO RELATED APPLICATION

This application claims the benefit of Korean Patent Application No. 10-2010-0080358, filed on Aug. 19, 2010, in the Korean Intellectual Property Office, the disclosure of which is incorporated herein by reference.

BACKGROUND

1. Field

Aspects relate to an image forming apparatus, and more particularly, to a charging apparatus using a charging tube.

2. Description of the Related Art

An image forming apparatus such as a printer, a facsimile machine, a copier, and a multifunction peripheral forms a predetermined image on a printing medium using electrophotography. Such an image forming apparatus generally carries out a charging process, a laser scanning process, a developing process, a transferring process, and a fusing process, in order to form an image. In the charging process, a charging apparatus electrically charges a photoconductive medium with a predetermined electric potential. In the laser scanning process, a laser scanning apparatus scans the photoconductive medium, which has been charged with the predetermined electric potential, with light, such that an electrostatic latent image corresponding printing data is formed on the photoconductive medium. In the developing process, a developing apparatus supplies toner to the photoconductive medium on which the electrostatic latent image is formed, thereby developing a toner image. In the transferring process, a transferring apparatus transfers the toner image formed on the photoconductive medium to a printing medium. In the fusing process, a fusing apparatus fuses the toner image onto the printing medium, thereby forming a predetermined image on the printing medium. After that, the printing medium is discharged out of the image forming apparatus and the image forming operation is completed.

In general, the charging apparatus is divided into an apparatus using a non-contact charging method and an apparatus using a contact charging method. The non-contact charging apparatus uses a corona discharge in general. The charging apparatus using the corona discharge has the advantage of charging a photoconductive medium uniformly, but has the disadvantage of generating a discharge product such as ozone. Therefore, an extra apparatus for processing the discharge product such as ozone is required and thus a size of the image forming apparatus increases and a manufacturing cost also increases.

The contact charging apparatus uses a charging roller which is in contact with a photoconductive medium and charges the photoconductive medium using a discharge occurring in a small gap between the charging roller and the photoconductive medium. The charging apparatus using the charging roller does not generate a discharge product such as ozone because it does not use a corona discharge, and makes it possible to achieve compactness of an image forming apparatus and reduce a manufacturing cost. However, there is a noise problem because the charging roller operates in contact with the photoconductive medium. Also, some of the low molecules forming the charging roller migrate to the photoconductive medium and thus there is a problem that the photoconductive medium is contaminated.

SUMMARY

Accordingly, it is an aspect to provide a charging apparatus using a charging tube and an image forming apparatus using the same.

Additional aspects and/or advantages will be set forth in part in the description which follows and, in part, will be apparent from the description, or may be learned by practice of the invention.

The foregoing and/or other aspects are achieved by providing a charging apparatus including: a charging tube which has an outer surface contacting a photoconductive medium and electrically charges a surface of the photoconductive medium, a shaft which is disposed in the charging tube and to which a charging voltage is applied, and a conductive member which is connected to the shaft and contacts an inner surface of the charging tube. A friction coefficient between the conductive member and the inner surface of the charging tube may be less than a friction coefficient between the photoconductive medium and the outer surface of the charging tube, so that a slip phenomenon of the charging tube is prevented.

The charging apparatus may further include an elastic member which presses the charging tube against the photoconductive medium.

The shaft may include a recess to receive the elastic member.

The elastic member may be fixedly inserted into the recess.

The conductive member and the elastic member may be fixedly inserted into the recess.

The shaft may have a U-shaped cross section.

A plurality of dimples may be formed on at least one of a surface of the conductive member contacting the charging tube and the inner surface of the charging tube.

The charging tube may include: a first layer which contacts the photoconductive medium, and a second layer which contacts the conductive member. A material forming the second layer may be different from a material forming the first layer so that a friction coefficient between the second layer and the conductive member is less than a friction coefficient between the first layer and the photoconductive medium.

An electric resistance of the second layer may be less than an electric resistance of the first layer.

The electric resistance of the first layer may be less than or equal to $10^8\Omega$ and the electric resistance of the second layer may be less than or equal to $10^4\Omega$.

The charging tube may be formed of nylon and a conductive additive.

The charging tube may be at least 0.1 mm thick.

The charging apparatus may further include a meandering prevention unit to prevent the charging tube from meandering in a lengthwise direction of the shaft.

The meandering prevention unit may include an extension part extending from one end of the shaft to face one end of the charging tube.

The meandering prevention unit may include an extension part extending from a support frame supporting the shaft to face one end of the charging tube.

A clearance between the meandering prevention unit and the charging tube may be greater than or equal to 0.1% and less than or equal to 3% of an entire length of the charging tube.

The conductive member may be formed of an elastic metal sheet and the metal sheet may have a curved portion formed at a portion contacting the inner surface of the charging tube.

The foregoing and/or other aspects may also be achieved by providing a charging apparatus including: a charging tube which has an outer surface contacting a photoconductive medium and electrically charges a surface of the photoconductive medium, and a shaft which contacts an inner surface of the charging tube and to which a charging voltage is applied. The charging tube may include a first layer which contacts the photoconductive medium and a second layer which contacts the shaft. A material forming the second layer may be different from a material forming the first layer, so that a friction coefficient between the second layer and the shaft is less than a friction coefficient between the first layer and the photoconductive medium.

The foregoing and/or other aspects may also be achieved by providing a developing cartridge comprising the charging apparatus as described above.

The foregoing and/or other aspects may also be achieved by providing an image forming apparatus comprising the charging apparatus as described above.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
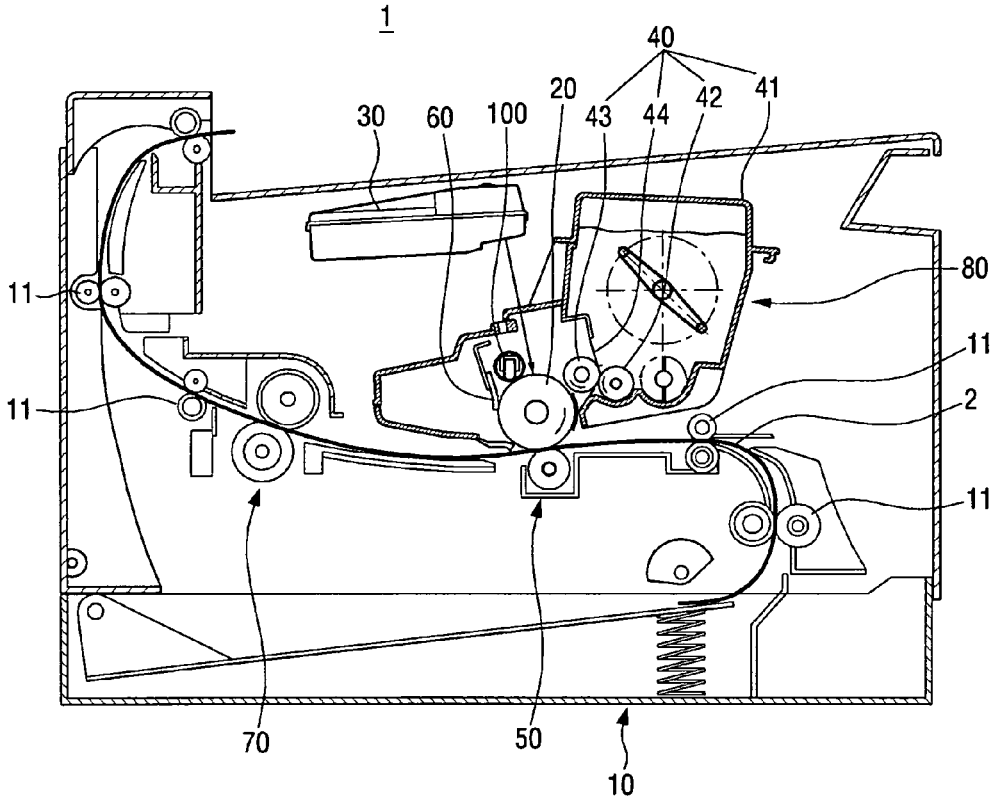
FIG. 1 is a schematic view illustrating an image forming apparatus according to an exemplary embodiment.

Reference will now be made in detail to the present embodiments, examples of which are illustrated in the accompanying drawings, wherein like reference numerals refer to the like elements throughout. The embodiments are described below in order to explain the embodiments by referring to the figures. It should be understood that various features are not drawn to scale and the dimensions of the various features may be arbitrarily increased or reduced for clarity of discussion.

FIG. 1 is a schematic view illustrating an image forming apparatus 1 according to an exemplary embodiment. The image forming apparatus 1 may be diverse apparatuses for forming a predetermined image on a printing medium such as printers, facsimile machines, copiers, and multifunction peripherals. FIG. 1 also illustrates an advancing path 2 of the printing medium.

A paper feeding apparatus 10 stores the printing medium such as paper therein. The printing medium is conveyed by a plurality of conveyance rollers 11 along the advancing path 2.

A charging apparatus 100 electrically charges a surface of a photoconductive medium 20 using a contact charging method. The charging apparatus 100 will be explained later in detail.

A laser scanning apparatus 30 scans the surface of the photoconductive medium 20 with light, thereby forming an electrostatic latent image corresponding to printing data on the surface of the photoconductive medium 20.

A developing apparatus 40 supplies toner to the surface of the photoconductive medium 20 on which the electrostatic latent image is formed, thereby developing a toner image. The developing apparatus 40 may include a toner container 41, a toner supply roller 42, a developing roller 43, and a regulation blade 44.

The toner container 41 contains toner therein. The toner supply roller 42 supplies the toner contained in the toner container 41 to the developing roller 42, thereby forming a toner layer on the developing roller 43. The regulation blade 44 makes the toner layer uniform. The toner layer formed on the developer roller 43 is moved to the electrostatic latent image formed on the surface of the photoconductive medium 20 due to a potential difference such that the toner image is developed.

A transferring apparatus 50 transfers the toner image formed on the surface of the photoconductive medium 20 to the printing medium.

A cleaning apparatus 60 removes toner remaining on the surface the photoconductive medium 20 after the transferring process.

A fusing apparatus 70 fuses the transferred toner image onto the printing medium. The printing medium onto which the toner image is fused is discharged to the outside of the image forming apparatus 1 through the plurality of conveyance rollers 11.

A developing cartridge 80 may integrally include the elements such as the charging apparatus 100, the photoconductive medium 20, and the developing apparatus 40. After the image forming apparatus 10 is used for a predetermined time, a user may remove the developing cartridge 80 and re-mount a new developing cartridge in the image forming apparatus 1. In this embodiment, the developing cartridge 80 includes the toner container 41 therein, but, in another exemplary embodiment, the developing cartridge 80 may not include the toner container 41 therein. In other words, there may be an extra toner cartridge for containing toner and such an extra toner cartridge may be combined with the developing cartridge 80. In this case, the user may replace the toner cartridge and the developing cartridge 80 separately.

Figure 2:
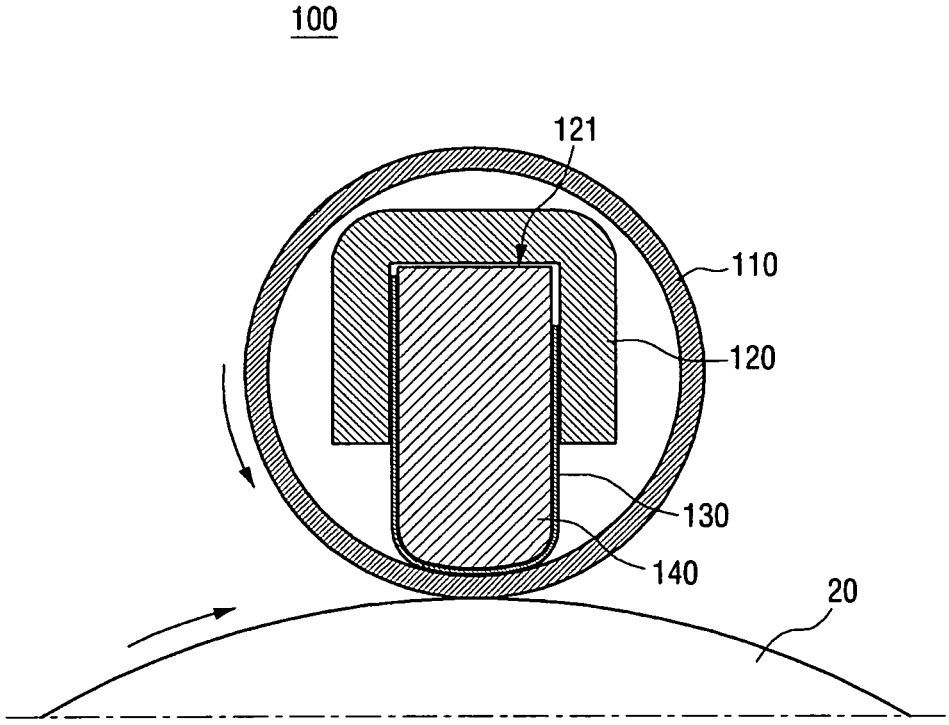
FIG. 2 is a schematic view illustrating a charging apparatus of FIG. 1.
Figure 3:
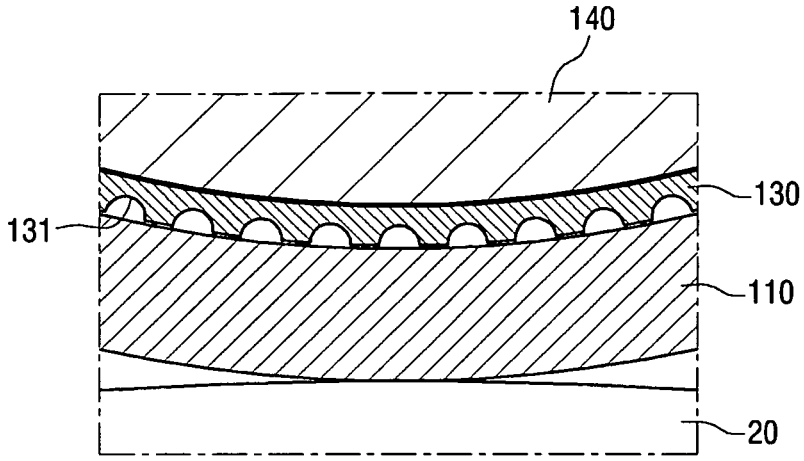
FIG. 3 is an enlarged view of a part of the charging apparatus of FIG. 2.

Hereinafter, the charging apparatus 100 according to a first exemplary embodiment will be explained in detail with reference to FIGS. 2 and 3. FIG. 2 is a schematic view illustrating the charging apparatus 100 of FIG. 1, and FIG. 3 is an enlarged view of a part of the charging apparatus 100 of FIG. 2.

A charging tube 110 has a hollow shape having an empty space therein. An outer surface of the charging tube 110 contacts the photoconductive medium 20 and the charging tube 110 electrically charges the surface of the photoconductive medium 20 in a contact charging method. The charging tube 110 may be formed of nylon and a conductive additive, for example. The conductive additive may be carbon black, an ion conductor, etc. As the photoconductive medium 20 is rotated, the charging tube 110 is also rotated due to a friction between the charging tube 110 and the photoconductive medium 20.

A shaft 120 is disposed in the charging tube 110. The shaft 120 may be formed of a metal material having conductivity, for example. A charging voltage for charging the surface of the photoconductive medium 20 is supplied to the shaft 120 from an external power source (not shown).

A conductive member 130 is connected to the shaft 120 and contacts an inner surface of the charging tube 110. The conductive member 130 may be formed in a thin film. The conductive member 130 may be formed of a material having flexibility and conductivity. The charging voltage applied to the shaft 120 may be transmitted to the charging tube 110 through the conductive member 130.

An elastic member 140 presses the charging tube 110 and the conductive member 130 against the photoconductive medium 20. The elastic member 140 may be formed of a sponge. The elastic member 140 makes the charging tube 110 stably in contact with the photoconductive medium 20.

The materials and the shapes of the charging tube 110, the shaft 120, the conductive member 130, and the elastic member 140 are merely examples and it should be understood that they can be modified variously.

The charging voltage applied to the shaft 120 is transmitted to the charging tube 110 through the conductive member 130 and accordingly a discharge occurs in a small gap of a wedge shape between the outer surface of the charging tube 110 and the photoconductive medium 20. Although the photoconductive medium 20 is a nonconductor of electricity, a surface potential is generated on the surface of the photoconductive medium 20 due to such a discharge phenomenon. The charging voltage applied to the shaft 120 may be an AC voltage, a DC voltage, or a mixture of the AC voltage and the DC voltage. Since the charging voltage could be easily understood by an ordinary skilled person in the related art, a detailed description thereof is omitted.

Figure 4:
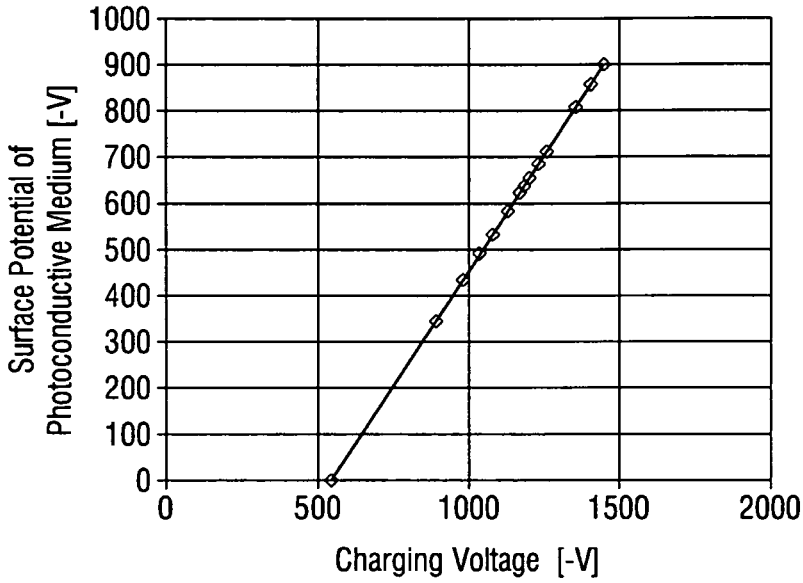
FIG. 4 is a graph illustrating change in a surface potential of a photoconductive medium according to change in a charging voltage.

FIG. 4 is a graph illustrating change in the surface potential of the photoconductive medium 20 according to change in the charging voltage. It can be seen from FIG. 4 that the surface potential is linearly changed according to the change in the charging voltage applied to the shaft 120. As described above, it can also be seen that the charging performance of the charging apparatus 100 is suitable for the image forming apparatus 1.

The charging apparatus 100 using the above-described discharge phenomenon may cause a noise. In particular, in the case that the charging voltage is the AC voltage, the noise becomes a serious problem. In order to reduce the noise, the charging apparatus 100 according to an exemplary embodiment uses the charging tube 110 of the hollow shape instead of a charging roller. Since the charging tube 110 is more flexible than the charging roller, the noise caused during the discharge can be reduced.

Also, the charging apparatus using the charging roller may contaminate the photoconductive medium since some of low molecules of the charging roller are migrated to the photoconductive medium. If the photoconductive medium is contaminated, image quality deteriorates. Such a migration phenomenon is more serious as a contact force between the charging roller and the photoconductive medium increases. Since the charging apparatus 100 according to an exemplary embodiment uses the charging tube 110 of the hollow shape instead of the charging roller, a mass of the charging tube 110 is noticeably less than that of the charging roller. Therefore, the contact force between the photoconductive medium 20 and the charging tube 110 is greatly reduced so that the migration phenomenon can be prevented.

As shown in FIG. 2, the shaft 120 includes a recess 121 to receive the elastic member 140 and has a U-shaped cross section. The conductive member 130 and the elastic member 140 are fixedly inserted into the recess 121 of the shaft 120. To achieve this, the recess 121 is formed to have a width a little less than an entire width of the conductive member 130 and the elastic member 140. In this case, a conductive adhesive for fixing the conductive member 130 and the elastic member 140 is not required so that a manufacturing process can be simplified and a cost of production can be reduced. Also, an electric resistance can be prevented from being increased due to the presence of the conductive adhesive, A slip phenomenon of the charging tube 110 may occur according to a working condition of the charging apparatus 100. In other words, even if the photoconductive medium 20 is well rotated, the charging tube 110 may not be rotated. In this case, the photoconductive medium 20 is not uniformly charged, causing unevenness in an image formed on the printing medium. As the charging tube 110 of the hollow shape is used, the mass or the moment of inertia of the charging tube 110 is reduced such that the charging tube 110 sensitively responds to a friction exerted to the inner surface (a surface contacting the conductive member 130) and the outer surface (a surface contacting the photoconductive medium 20). Therefore, the slip phenomenon occurs more easily in the case of the charging tube 110 than in the case of using the charging roller.

According to various working conditions, such as temperature, a contact force and material composition, the friction exerted to the inner surface and the outer surface of the charging tube 110 is changed. In order to prevent the slip phenomenon of the charging tube 110, it is necessary to significantly reduce a friction coefficient between the conductive member 130 and the inner surface of the charging tube 110 less than a friction coefficient between the photoconductive medium 20 and the outer surface of the charging tube 110 in the various working conditions. As shown in FIG. 3, a plurality of dimples 131 are formed on one surface of the conductive member 130 contacting the charging tube 110. The inventors found out that the friction coefficient between the conductive member 130 and the inner surface of the charging tube 110 is greatly reduced because of the plurality of dimples 131 formed on the one surface of the conductive member 10. Accordingly, the charging apparatus 100 according to an exemplary embodiment can prevent the slip phenomenon of the charging tube 110 and deterioration of the image quality. According to another exemplary embodiment, a plurality of dimples may be formed on the inner surface of the charging tube 110 rather than the conductive member 130 or a plurality of dimples may be formed on both the conductive member 130 and the inner surface of the charging tube 110.

Figure 5:
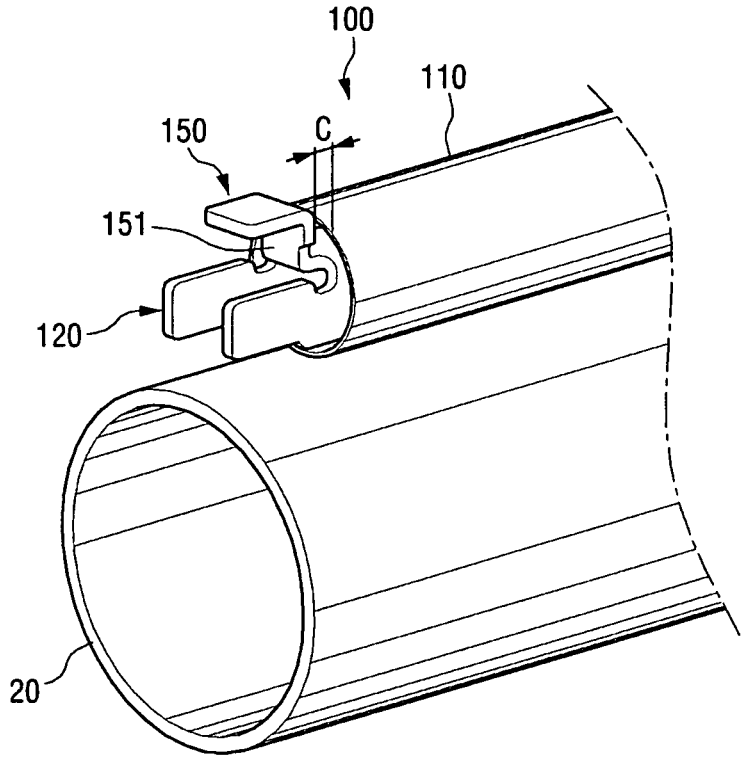
FIG. 5 is a perspective view illustrating one end of the charging apparatus to show an example of a meandering prevention unit.

FIG. 5 is a perspective view illustrating one end of the charging apparatus 100 to show an example of a meandering prevention unit 150.

The charging tube 110 is rotated in contact with the photoconductive medium 20, but an ununiform contact force may be generated along a lengthwise direction of the shaft 120. The ununiform contact force may cause the charging tube 110 to meander in the lengthwise direction of the shaft 120.

The meandering prevention unit 150 is able to prevent the charging tube 110 from meandering along the lengthwise direction of the shaft 120. As shown in FIG. 5, the meandering prevention unit 150 may include an extension part 151 extending from one end of the shaft 120. The extension part 151 is formed to face one end of the charging tube 110. If the charging tube 110 meanders further than a predetermined distance, the extension part 151 prevents the charging tube 110 from meandering. Albeit not shown, a part similar to the extension part 151 of FIG. 5 may be formed on the shaft 120 at the other end of the charging apparatus 100. Since the extension part 151 is integrally formed with the shaft 120, an extra element for preventing the charging tube 110 from meandering is not required so that the manufacturing process can be simplified and the manufacturing cost can be reduced.

A clearance 'c' between the meandering prevention unit 150 and the charging tube 110 is designed in consideration of a coefficient of thermal expansion of the charging tube 110 and an image forming area. The clearance 'c' may be greater than or equal to 0.1% and less than or equal to 3% of the entire length of the charging tube 110. If the clearance 'c' is less than 0.1% of the entire length of the charging tube 110, the meandering prevention unit 140 may press the charging tube 110 when the charging tube 110 thermally expands and thus the charging tube 110 may be deformed regardless of whether the meandering of the charging tube 110 occurs or not. On the other hand, if the clearance 'c' is greater than 3% of the entire length of the charging tube 110, the charging tube 110 suffers from great meandering before the meandering prevention unit 150 prevents the meandering of the charging tube 110 and thus is likely to be deviated from the image forming area (in other words, a width of a printing medium).

If a hardness of the charging tube 110 is weak, one end of the charging tube 110 contacting the meandering prevention unit 150 may wear out easily or may be damaged when the meandering prevention unit 150 prevents the meandering of the charging tube 110. Therefore, the charging tube 110 needs to have a hardness greater than a predetermined level. To achieve this, it is preferable that the charging tube 110 is at least 0.1 mm thick and it is more preferable that the charging tube 110 is 0.15 mm thick.

Figure 6:
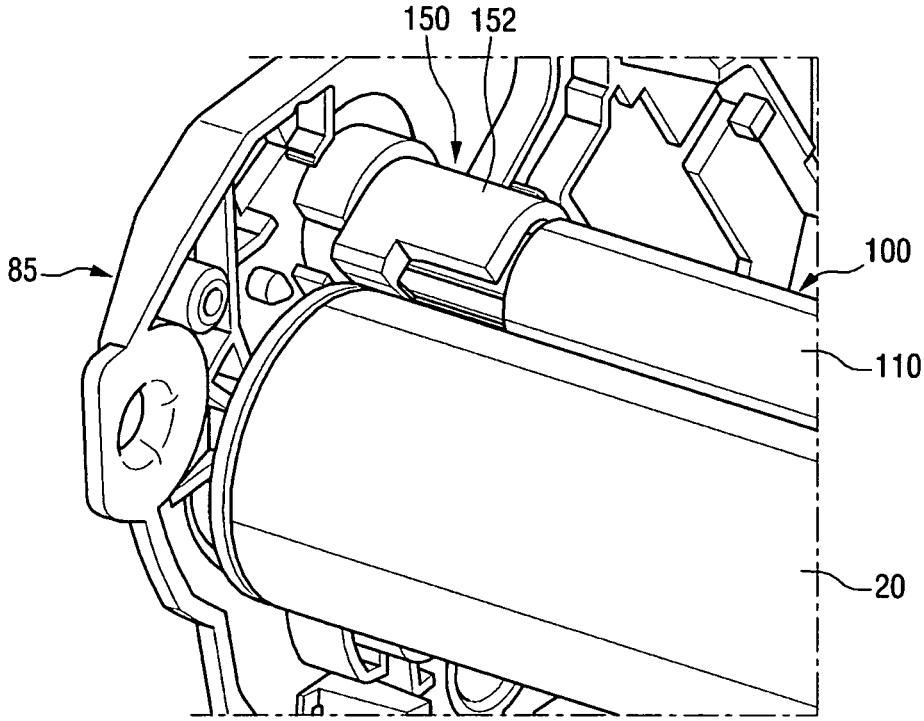
FIG. 6 is a perspective view illustrating one end of the charging apparatus to show another example of a meandering prevention unit.

FIG. 6 is a perspective view illustrating one end of the charging apparatus 100 to show another example of the meandering prevention unit 150.

A support frame 85 rotatably supports the photoconductive medium 20 and also supports the shaft 120 of the charging apparatus 100. The support frame 85 may be a lateral frame of the developing cartridge 80. As shown in FIG. 6, the meandering prevention unit 150 may include an extension part 152 extending from the support frame 85. The extension part 152 is formed to face one end of the charging tube 110. If the charging tube 110 meanders further than a predetermined distance, the extension part 152 prevents the charging tube 110 from meandering. Albeit not shown, a part similar to the extension part 152 of FIG. 6 may be formed on the other end of the charging apparatus 100. Since the extension part 152 is integrally formed with the support frame 85, an extra element for preventing the meandering of the charging tube 110 is not required so that the manufacturing process can be simplified and the manufacturing cost can be reduced.

Figure 7:
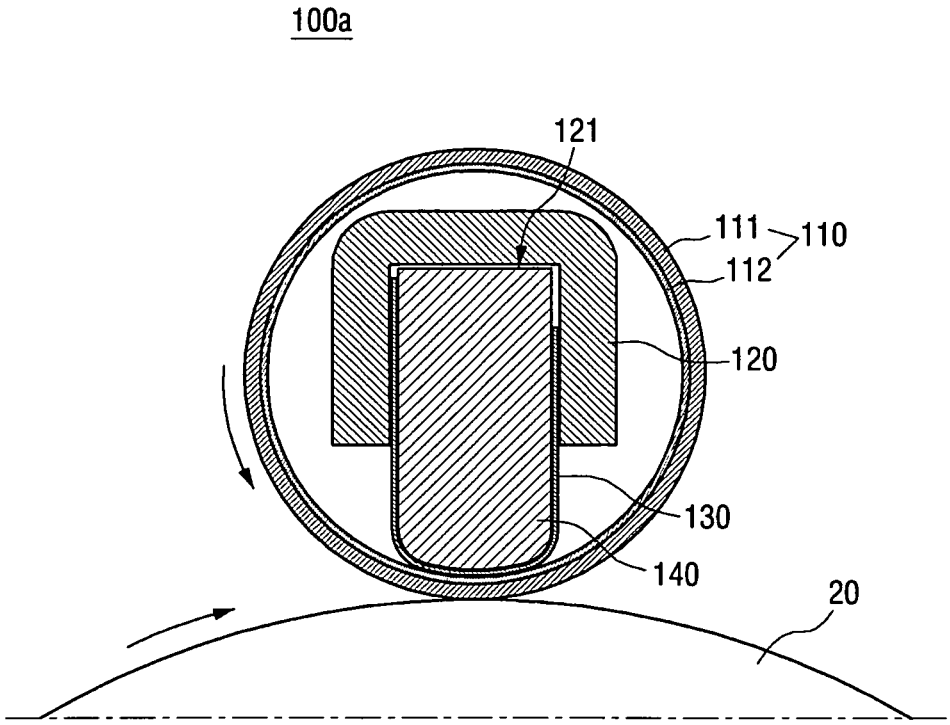
FIGS. 7 to 10 are schematic views illustrating a charging apparatus according to another exemplary embodiment.

FIG. 7 is a schematic view illustrating a charging apparatus 100*a* according to a second exemplary embodiment. The elements performing the same functions as those of the aforementioned embodiment are given the same reference numerals and a detailed description thereof is omitted.

In the first exemplary embodiment shown in FIG. 2, the plurality of dimples are formed on the conductive member 130 in order to prevent the slip phenomenon of the charging tube 110, whereas in the second exemplary embodiment shown in FIG. 7, the charging tube 110 includes a first layer 111 and a second layer 112 instead of having the plurality of dimples formed on the conductive member 130. The first layer 111 contacts the photoconductive medium 20 and the second layer 112 contacts the conductive member 130. The second layer 112 is formed of a material different from that of the first layer 111 so that a friction coefficient between the second layer 112 and the conductive member 130 is greatly lower than a friction coefficient between the first layer 111 and the photoconductive medium 20. Accordingly, the slip phenomenon of the charging tube 110 can be prevented.

In the second exemplary embodiment of FIG. 7, in order to further reduce the friction coefficient between the second layer 112 and the conductive member 130, a plurality of dimples may be formed on the conductive member 130 as in the first exemplary embodiment. Alternatively, the plurality of dimples may be formed on the second layer 112 of the charging tube 110 or may be formed on both the second layer 112 of the charging tube 110 and the conductive member 130.

An electric resistance of the charging tube 110 should be more than a predetermined level in order to prevent a discharge generated in a small gap of a wedge shape between the outer surface of the charging tube 110 and the photoconductive medium 20 from becoming a spark discharge. However, if the electric resistance of the charging tube 110 is excessive, the photoconductive medium 20 may not be charged uniformly. In order to prevent ununiform charging, the materials forming the first and the second layers 111 and 112 are adjusted so that an electric resistance of the second layer 112 is less than an electric resistance of the first layer 111. As the electric resistance of the second layer 112 which is formed on the inner surface of the charging tube 110 is lowered, electric conduction can be improved and ununiform charging can be prevented. It is preferable that the electric resistance of the first layer 111 is less than or equal to $10^8\Omega$ and the electric resistance of the second layer 112 is less than or equal to $10^4\Omega$.

In the charging tube 110 according to the second exemplary embodiment of FIG. 7, the second layer 112 may be coated over an inner surface of the first layer 111 by a coating process. Alternatively, the first layer 111 may be coated over an outer surface of the second layer 112 by a coating process. By this coating process, the first layer 111 and the second layer 112 may be formed of different materials. To this end, the electric resistances and the friction coefficients of the first and the second layers 111 and 112 become different. Herein, the coating process is used for forming the first and the second layer 111 and 112 with different material. However, this is merely an example and the charging tube 110 may be manufactured by various methods besides the coating process. For example, the first layer 111 and the second layer 112 may be manufactured separately and then bonded to each other.

Although the charging tube 110 includes the first layer 111 and the second layer 112 in the second exemplary embodiment of FIG. 7, the charging tube 110 may further include another layer between the first and the second layers 111 and 112.

Figure 8:
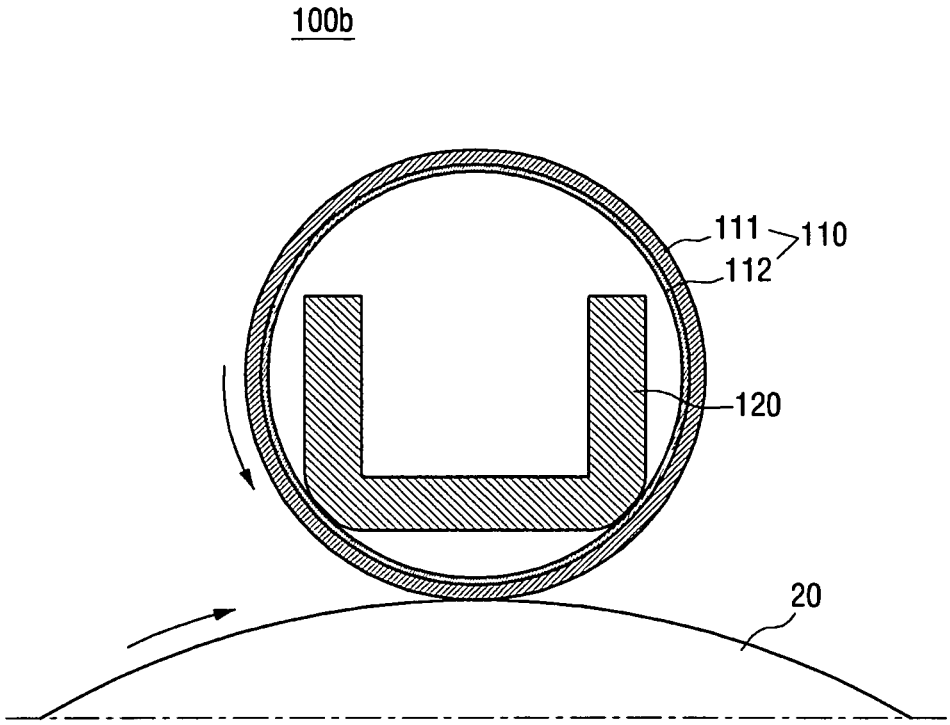

FIG. 8 is a schematic view illustrating a charging apparatus 100*b* according to a third exemplary embodiment. The elements performing the same functions as those of the aforementioned embodiments are given the same reference numerals and a detailed description thereof is omitted.

Unlike in the aforementioned embodiments, in the third exemplary embodiment of FIG. 8, the conductive member 130 and the elastic member 140 are not used. Instead, the shaft 120 contacts the inner surface of the charging tube 110, more specifically, the second layer 112 of the charging tube 110. Therefore, the charging voltage applied to the shaft 120 is transmitted directly to the charging tube 110 without passing the conductive member 130. Since the conductive member 130 and the elastic member 140 are omitted, the manufacturing process can be simplified and the manufacturing cost can be reduced.

By forming the first layer 111 and the second layer 112 with different materials, the friction coefficient between the first layer 112 and the shaft 120 is made less than the friction coefficient between the first layer 111 and the photoconductive medium 20 and the electric resistance of the second layer 112 is made less than the electric resistance of the first layer 111. To this end, the slip phenomenon of the charging tube 110 and the ununiform charging can be prevented. Also, in order to further reduce the friction coefficient between the second layer 112 and the shaft 120, the plurality of dimples may be formed on a part of the shaft 120 contacting the first layer 111 and/or the second layer 112.

Figure 9:
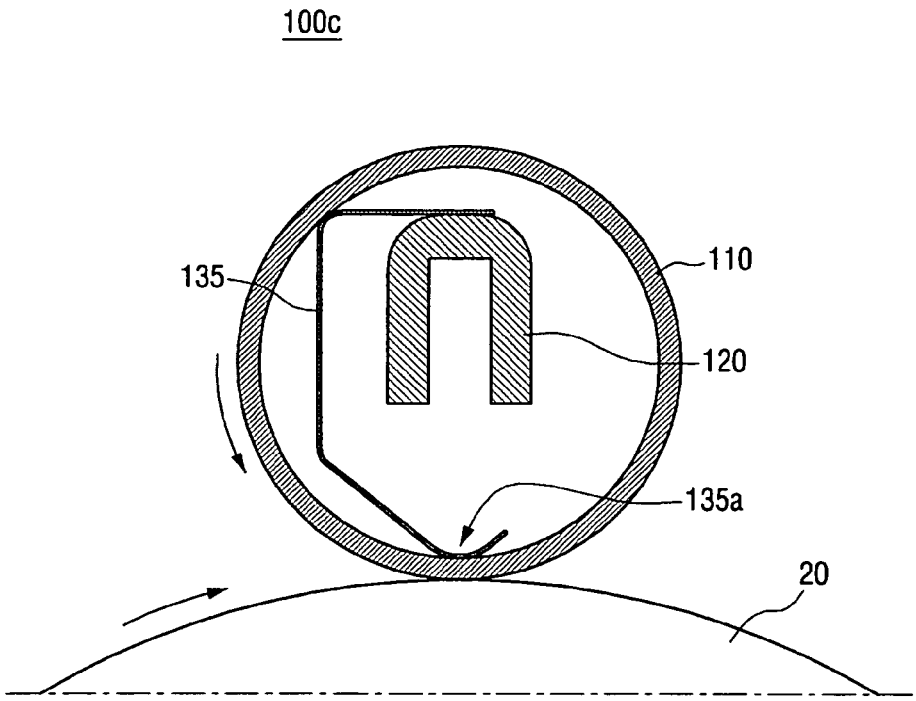

FIG. 9 is a schematic view illustrating a charging apparatus 100*c* according to a fourth exemplary embodiment. The elements performing the same functions as those of the aforementioned embodiment are given the same reference numerals and a detailed description thereof is omitted.

In the fourth exemplary embodiment, the elastic member 140 is omitted and an elastic metal sheet 135 is formed for the conductive member 130. The metal sheet 135 may be a stainless steel plate (SUS). Since the metal sheet 135 has elasticity, the metal sheet 135 is able to generate a sufficient contact force between the metal sheet 135 and the photoconductive medium 20 even if no elastic member 140 exists.

If the contact force between the metal sheet 135 and the photoconductive medium 20 excessively increases, the surface of the photoconductive medium 20 may be damaged and the charging tube 110 may be deformed. Accordingly, as shown in FIG. 9, the metal sheet 135 may be bent at least two times.

The metal sheet 135 has a curved portion 135*a* at a portion contacting the inner surface of the charging tube 110. A radius of curvature of the curved portion 135*a* is equal to that of the charging tube 110. Since a friction coefficient between the metal sheet 135 and the inner surface of the charging tube 110 is reduced due to the curved portion 135*a*, the charging tube 110 is smoothly rotated without any slip phenomenon.

Figure 10:
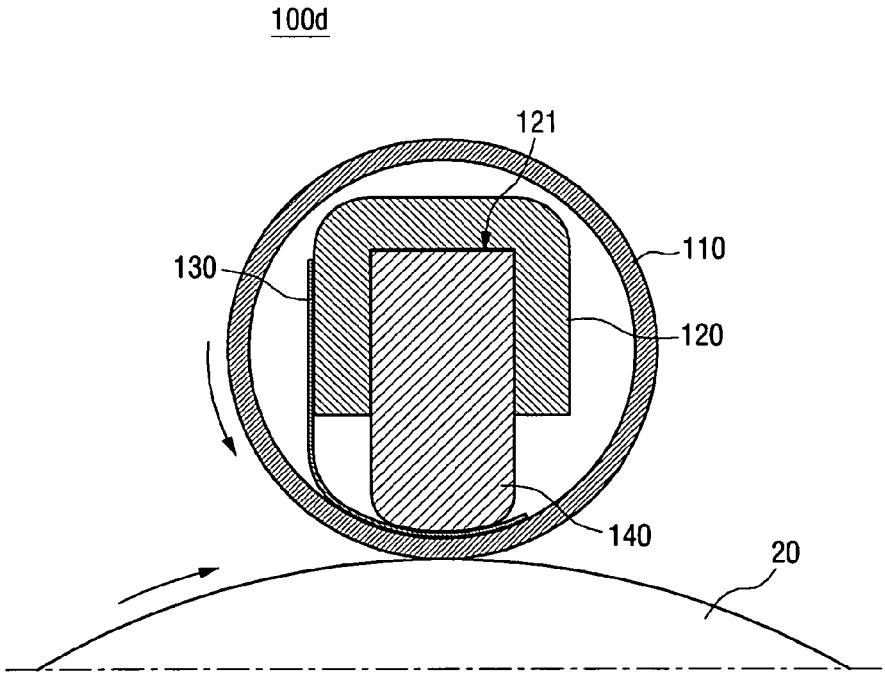

FIG. 10 is a schematic view illustrating a charging apparatus 100*d* according to a fifth exemplary embodiment. The elements performing the same functions as those of the aforementioned embodiments are given the same reference numerals and a detailed description thereof is omitted.

The fifth exemplary embodiment of FIG. 10 is similar to the first embodiment of FIG. 2, except for the position of the conductive member 130. Only the elastic member 140 is inserted into the recess 121 of the shaft 120. In the fifth embodiment of FIG. 10, the conductive member 130 is bonded to a side surface of the shaft 120 rather than being fixedly inserted into the recess 121 of the shaft 120 so that the conductive member 130 can be fixed more stably. Therefore, the conductive member 130 is prevented from being separated from the shaft 120 during the operation of the charging apparatus 100*d*.

Although a few embodiments have been shown and described, it would be appreciated by those skilled in the art that changes may be made in this embodiment without departing from the principles and spirit of the invention, the scope of which is defined in the claims and their equivalents.

What is claimed is:

1. A charging apparatus comprising:

a charging tube which has an outer surface contacting a photoconductive medium and electrically charges a surface of the photoconductive medium;

a shaft which is disposed in the charging tube and to which a charging voltage is applied;

a conductive member which is connected to the shaft and contacts an inner surface of the charging tube; and an elastic member which presses the charging tube against the photoconductive medium, wherein a friction coefficient between the conductive member and the inner surface of the charging tube is less than a friction coefficient between the photoconductive medium and the outer surface of the charging tube, so that a slip phenomenon of the charging tube is prevented, and the shaft comprises a recess to receive the elastic member.

2. The charging apparatus as claimed in claim 1, wherein the elastic member is fixedly inserted into the recess.

3. The charging apparatus as claimed in claim 1, wherein the conductive member and the elastic member are fixedly inserted into the recess.

4. The charging apparatus as claimed in claim 1, wherein the shaft has a U-shaped cross section.

5. The charging apparatus as claimed in claim 1, wherein the charging tube is formed of nylon and a conductive additive.

6. The charging apparatus as claimed in claim 1, wherein the charging tube is at least 0.1 mm thick.

7. A developing cartridge comprising the charging apparatus as claimed in claim 1.

8. An image forming apparatus comprising the charging apparatus as claimed in claim 1.

9. A charging apparatus comprising:

a charging tube which has an outer surface contacting a photoconductive medium and electrically charges a surface of the photoconductive medium;

a shaft which is disposed in the charging tube and to which a charging voltage is applied; and a conductive member which is connected to the shaft and contacts an inner surface of the charging tube, wherein a friction coefficient between the conductive member and the inner surface of the charging tube is less than a friction coefficient between the photoconductive medium and the outer surface of the charging tube, so that a slip phenomenon of the charging tube is prevented, and a plurality of dimples are formed on at least one of a surface of the conductive member contacting the charging tube and the inner surface of the charging tube.

10. A charging apparatus comprising:

a charging tube which has an outer surface contacting a photoconductive medium and electrically charges a surface of the photoconductive medium;

a shaft which is disposed in the charging tube and to which a charging voltage is applied; and a conductive member which is connected to the shaft and contacts an inner surface of the charging tube, wherein a friction coefficient between the conductive member and the inner surface of the charging tube is less than a friction coefficient between the photoconductive medium and the outer surface of the charging tube, so that a slip phenomenon of the charging tube is prevented, and the charging tube comprises a first layer which contacts the photoconductive medium; and a second layer which contacts the conductive member, wherein a material forming the second layer is different from a material forming the first layer so that a friction coefficient between the second layer and the conductive member is less than a friction coefficient between the first layer and the photoconductive medium.

11. The charging apparatus as claimed in claim 10, wherein an electric resistance of the second layer is less than an electric resistance of the first layer.

12. The charging apparatus as claimed in claim 11, wherein the electric resistance of the first layer is less than or equal to $10^8\Omega$ and the electric resistance of the second layer is less than or equal to $10^4\Omega$.

13. A charging apparatus comprising:

a charging tube which has an outer surface contacting a photoconductive medium and electrically charges a surface of the photoconductive medium;

a shaft which is disposed in the charging tube and to which a charging voltage is applied;

a conductive member which is connected to the shaft and contacts an inner surface of the charging tube; and a meandering prevention unit to prevent the charging tube from meandering in a lengthwise direction of the shaft, wherein a friction coefficient between the conductive member and the inner surface of the charging tube is less than a friction coefficient between the photoconductive medium and the outer surface of the charging tube, so that a slip phenomenon of the charging tube is prevented.

14. The charging apparatus as claimed in claim 13, wherein the meandering prevention unit comprises an extension part extending from one end of the shaft to face one end of the charging tube.

15. The charging apparatus as claimed in claim 13, wherein the meandering prevention unit comprises an extension part extending from a support frame supporting the shaft to face one end of the charging tube.

16. The charging apparatus as claimed in claim 13, wherein a clearance between the meandering prevention unit and the charging tube is greater than or equal to 0.1% and less than or equal to 3% of an entire length of the charging tube.

17. A charging apparatus comprising:

a charging tube which has an outer surface contacting a photoconductive medium and electrically charges a surface of the photoconductive medium;

a shaft which is disposed in the charging tube and to which a charging voltage is applied; and a conductive member which is connected to the shaft and contacts an inner surface of the charging tube, wherein a friction coefficient between the conductive member and the inner surface of the charging tube is less than a friction coefficient between the photoconductive medium and the outer surface of the charging tube, so that a slip phenomenon of the charging tube is prevented, and the conductive member is formed of an elastic metal sheet and the metal sheet has a curved portion formed at a portion contacting the inner surface of the charging tube.

18. A charging apparatus comprising:

a charging tube which has an outer surface contacting a photoconductive medium and electrically charges a surface of the photoconductive medium; and a shaft which contacts an inner surface of the charging tube and to which a charging voltage is applied, wherein the charging tube comprises a first layer which contacts the photoconductive medium and a second layer which contacts the shaft, wherein a material forming the second layer is different from a material forming the first layer, so that a friction coefficient between the second layer and the shaft is less than a friction coefficient between the first layer and the photoconductive medium.

* * * * *